US005360217A

United States Patent [19]

Taylor

[11] Patent Number: 5,360,217

[45] Date of Patent: Nov. 1, 1994

[54] COLLECTIBLE FACTSPAK CARD BOARD GAME

[76] Inventor: H. LeBaron Taylor, 504 Sunshine Lakes Dr., Voorhees, N.J. 08043

[21] Appl. No.: 925,511

[22] Filed: Aug. 4, 1992

[51] Int. Cl.[5] ..... A63F 3/00; A63B 71/00

[52] U.S. Cl. ..... 273/459; 273/139

[58] Field of Search ..... 273/459, 269, 138 R, 273/139 R

[56] References Cited

U.S. PATENT DOCUMENTS

| | | | |
|---|---|---|---|
| 3,493,230 | 2/1970 | Curzon | 273/269 X |
| 4,285,520 | 8/1981 | Small | 273/269 X |
| 4,577,869 | 3/1986 | Brinkman | 273/269 |
| 4,703,933 | 11/1987 | Cahill et al. | 273/139 |
| 4,775,154 | 10/1988 | Clinnin et al. | 273/138 R |

OTHER PUBLICATIONS

Mobil Monopoly, advertising circular Oct. 1984.

*Primary Examiner*—Paul E. Shapiro

*Attorney, Agent, or Firm*—David Edwards

[57] ABSTRACT

A collectible card board game is provided that includes a game sheet, a plurality of pocket size game boards, and a deck of collectible figure cards. This game uses outstanding personalities, both present and past, from many different categories as representations on the figure cards. The game sheet, game board, and cards are distributed to players through targeted items; rewards are provided for when a category is completed. This game will encourage its participants to learn the names and historical facts on outstanding personalities in a particular category of play while at the same time having fun collecting collectible cards and competing with others not to mention winning prizes.

7 Claims, 1 Drawing Sheet

COLLECTIBLE FACTSPAK CARD BOARD GAME

BACKGROUND OF THE INVENTION

This invention relates to a new educational board game using collectible figure cards.

Prior to the present invention most collectible card board games were related to using sports figures cards and were not versatile enough to use different categories of outstanding personalities, both present and past, in order to not only be enjoyable as a game but also to be educational, especially for young adults. U.S. Pat. No. 5,071,136 is an example of a prior art collectible sport card board game that requires at least two players, and uses two dice and a game board divided up into rows of rectangles constituting a matrix.

SUMMARY OF THE INVENTION

This invention is directed to a collectible card board game for one or more players comprising (a) a game sheet the surface of which is divided up into a plurality of symmetrically shaped rectangles that are disposed in horizontal and vertical rows of rectangles, the rows of rectangles are divided up into groups that are color coded and numbered where each group of rectangles either has the same number labeled therein or is consecutively numbered which denotes different categories of collectible figures, the sizes of the groups are from 4–10 depending on the size of the board, and the number of categories are from 2 to 13;

(b) a plurality of pocket size game boards where each board is divided up into from 4–10 rectangularly shaped boxes with each board having the same number in each of the boxes or is consecutively numbered and is the same color but each card in the plurality of game boards is a different color and either has a different number thereon or is numbered consecutively;

(c) a deck of collectible figure cards with each card having thereon a representation of a collectible figure in a particular category of collectibles, each individual card comprises at least 2 leafs with factual information of the collectible figure being on one or more surfaces of the leafs in order to educate a player of vital information concerning the collectible figure and also is color coded and has two stickers that are color coded and has a number thereon corresponding to one of the numbers on the game sheet and game board, each deck of collectible figure cards includes 4 to 10 cards with not more that two cards in the deck having the same color and numbers thereon; in a select few of the decks of cards (i.e., less than 3 percent of all of the decks of card) a wild card may be placed that is different than the other cards in the deck but can be used in place of any card in one category in order to complete that category in the game;

(d) for distributing the decks of cards to the players comprising a member selected from the group consisting of a manufacturer of commodity goods, a retailer, an eatery, or an educational institution wherein through a random computer selection decks of cards for different categories are placed in packaging of various targeted items and/or are distributed to the players when the particular targeted items are disseminated to the players, each designated targeted item includes one deck of cards; and (e) means for providing rewards at different levels of play.

DETAILED DESCRIPTION OF THE INVENTION

This card game is played over a definite time period such as 3 to 4 months but can be shortened or lengthened depending on the sponsor and categories that are selected for this educational enlightenment. For example, the focus of the game during a game time period can be on sports, technology, ethnic groups, entertainment, etc where excellency has been achieved.

This game is played by obtaining targeted items from the sponsor, for example, by purchasing commodity products that include a game pack, such as a six pack of soft drinks, when the sponsor is either a manufacturer of commodity or a retailer. The commodity items would be specifically marked and sold at participating retailers. The sponsor of the game would be a manufacturer who desires to promote a particular focus of personalities for a particular time period such as during the Olympics; a sponsor may wish to focus on Olympians for the month of the Olympics. Also, during Black History month, a sponsor may wish to focus on Black leaders in different fields of activity. Educational institutions such as libraries or schools can use library books or other means to disseminate the targeted items. Eateries can disseminate the targeted items by the purchase of certain of its menu items or any means it desires. The different focuses and distribution means of targeted items for this game are unlimited.

Since children love to play games and collect cards, this game will encourage them to learn a particular subject while enjoying the competition aspect of the game. This game encourages players, such as children, to discuss their different cards with other players as well as to trade the cards among themselves for completing in different categories and at different levels for winning prizes or for moving quickly to a different higher level. The more levels that a player completes, the bigger the possible reward becomes.

Figure 1:
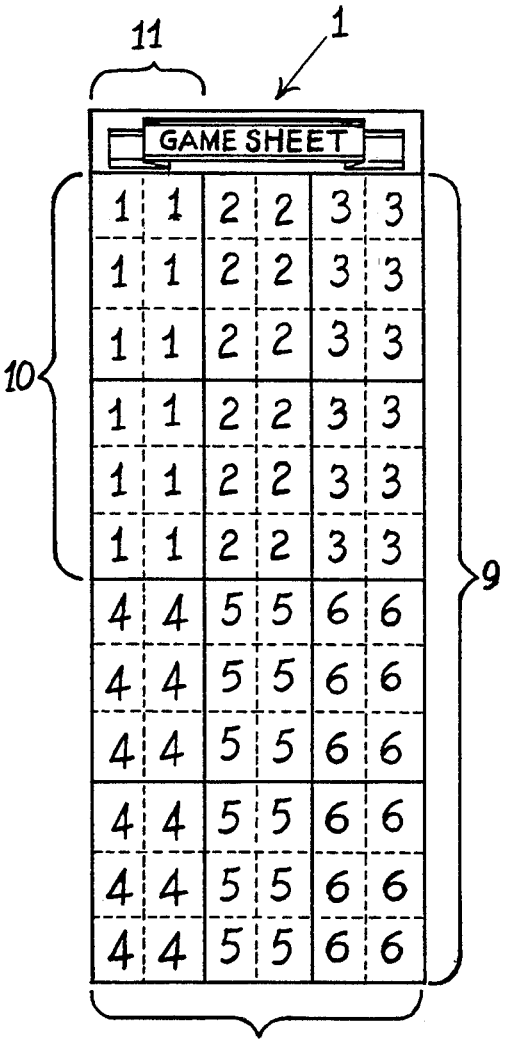
FIG. 1 is a plan view of the game sheet of this invention.

Referring to FIG. 1 of the drawings, reference numeral 1 denotes the game sheet of this invention the surface of which is divided into a plurality of horizontally and vertically disposed rows of rectangles indicated horizontally as 8 and vertically as 9. The total number of rectangles depicted on the surface of the game sheet 1 may vary according to the number of categories that a sponsor is using in the particular game. In the game depicted in the drawing, the number of rectangles is 72. Numerals 10 and 11 show the position of twelve stickers that must be placed on this sheet for completion of the first category; the number 1 has been shown in the sheet twelve times to indicate the positions of stickers that must be obtained and placed thereon. It should be understood that these twelve boxes could have been numbered consecutively from one to twelve as an alternative embodiment and that a wild card can be used in place of any one card to complete this category. This sheet shows six categories of personalities that must be completed on this sheet 1 in order to be eligible for the grand prize. The categories can be completed in any order.

Figure 2:
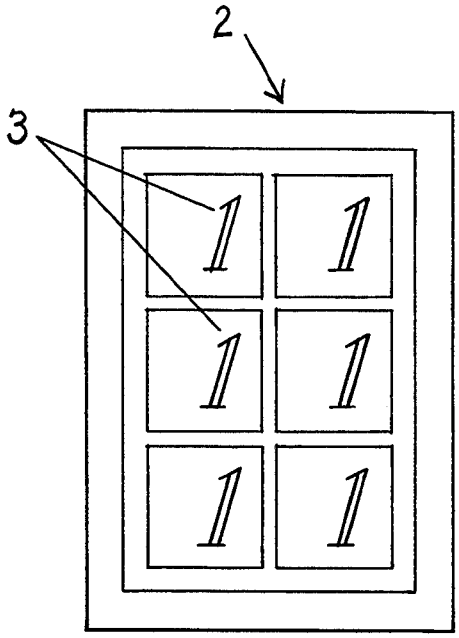
FIG. 2 is a plan view of a game board of this invention.

FIG. 2 shows a game board 2 that is smaller than the game sheet 1 usually the size of the cards in the deck for carrying in a player's pocket. This game board 2 is divided into six rectangles with a particular number depicted thereon for sticking six stickers 4 from six different cards 5. The different stickers 4 for different categories are different colors (such as blue, purple, green, orange, red, and yellow). It should be understood that this board 2 could have been consecutively numbered from one to six as an alternative embodiment.

Figure 3:
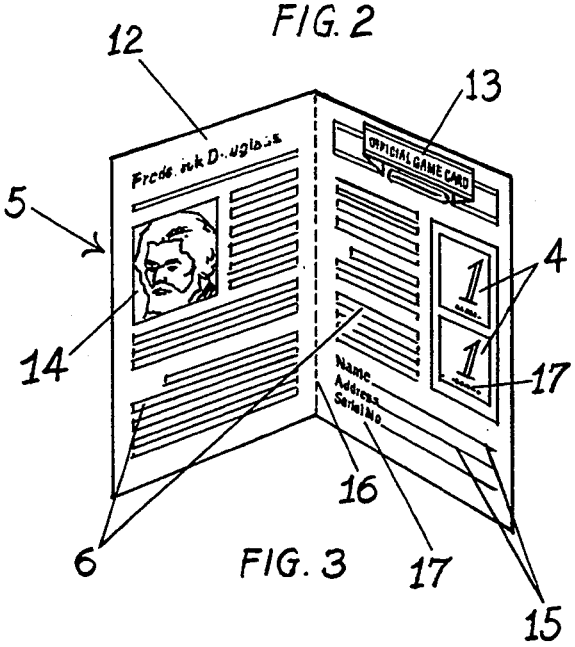
FIG. 3 is a plan view of a two leaf card of this invention.
Figure 4:
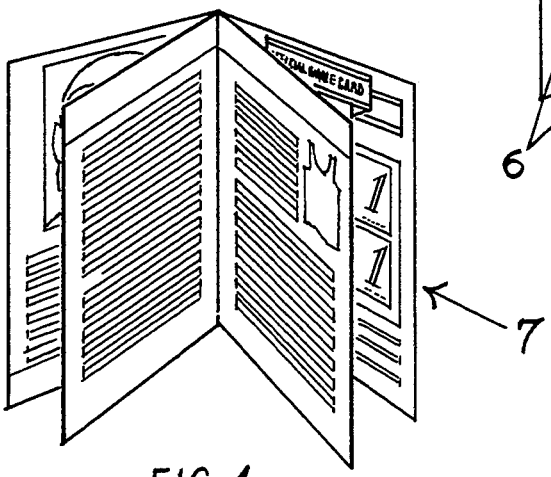
FIG. 4 is a side view of a game card with a plurality of leafs.

FIG. 3 shows a game card 5 with two leafs 12 and 13. On one of the leafs, a representation of a collectible personality 14 is depicted with biographic information 6 shown on the two leafs. Two removable stickers 4 of a particular color are on the other leaf of this card for placing one sticker on the game sheet 1 and the other sticker on the game board 2. This leaf is the voucher that has a place on it for the player to insert his name and address 15 for participating in a grand prize drawing. The leafs of this game card have a perforated seam 16 between them for easy separation. The stickers and voucher portion of the game card have up to a six digit serial number 17 imprinted on them for verification of legitimacy of stickers. FIG. 4 shows a game card 7 with four leafs therein that contain additional biographic information for educating the players relative to the collectible representation. It is understood that the number of leafs of the cards can be from at least two and preferably from two to five. One of the leafs, normally the last leaf, is the voucher that has a perforated seam and a place for the player to insert his name and address for participating in a grand prize drawing. The rules of the game are also printed on the voucher portion of the card 5 or 7.

During a selected time period of a particular game, if a player obtains the right cards such as through either trading with other players or purchasing the correct commodity that has the right cards therein, the player is eligible for either obtaining intermediary prizes or for participating in a grand prize drawing. Prizes are awarded in the following order.

When a player obtains six cards in a single category, the player can take the game board to a participating sponsor (or his agent) with all six of the stickers thereon in the same color and category (all having the same serial number thereon) and claim his intermediary prize; he will have to turn in this portion of the board game but he will keep the game sheet. After he has collected all twelve (or the designated number) cards in a particular category, the player can either turn in the game sheet and vouchers to participate in a first level grand prize for a category or he can keep his game sheet and vouchers and continue to collect other cards in other categories. If a player gives up his game sheet at a particular level such as after he collects all the cards in a particular category, he must start over to collect the complete number of cards in the total game for the ultimate grand prize. Whenever a game board is completed with all the stickers, the player can turn it in for an intermediary prize for that category without losing the benefit of continuing in the game for the ultimate grand prize.

After completion of any category (i.e., collect all twelve cards or the designated number), at the player's election, he can turn in his game sheet and the corresponding number of vouchers for verification and participate in the grand prize for that category or for the number of categories that he has completed. The prizes are substantially increased for the number of categories that have been completed. For example, where the game has six categories with twelve cards in each category, a player can participate in the ultimate grand prize drawing only after he collects all seventy two cards and turn in seventy two corresponding vouchers for verification.

An example of the grand prizes for each of the levels is as follows: When one category is completed, player can participate in a drawing for $12,000.00 in prizes; when two categories are completed, the player can participate in a drawing for $24,000.00 in prizes; when three categories are completed, the player can participate in a drawing for $36,000.00 in prizes; when four categories are completed, the player can participate in a drawing for $48,000.00 in prizes; when five categories are completed, the player can participate in a drawing for $60,000.00 in prizes; and finally, when six categories are completed, the player can participate in a drawing for $72,000.00 in prizes. The grand prizes in each of these categories can be in the form or money, scholarships, equipment, automobiles, etc.; the form that the prizes takes is up to the sponsor.

An example of an intermediary prize that a player can collect whenever he collects six cards in any category, is a six pack of soft drinks (depending on the participating sponsor) or an equivalent merchandise gift of approximate the same value or even cash. Another option is for the player to participate in a drawing for prizes at this intermediary level. The prizes at this level would be of a value of $60.00 for the first six card. When a person collects all 12 cards in this category, the player will be eligible for a second intermediary level of drawing for prizes of $120.00 value by turning in his completed games boards. If he turns in his game sheet at the completion of this category, he will be eligible for the grand prize at this level but he cannot continue for the ultimate grand prize or for any other prize at a higher level of play.

Although the sponsor can select the categories that it wishes to focus its game on, examples of the categories can be scientists, Athletes, Scholars, writers, poets, public officials, entertainers, etc. These categories can be set up by ethnic groups, religion, gender, etc or a combination of these. For example, the theme of the game can be African Americans and the categories can be broken down into outstanding African Americans in civil rights, scientists, athletes, scholars, public officials, and entertainers. Representatives in each of these categories are well known in the historical literature; as an educational tool, lesser known persons that have contributed to the community can be selected for this game in order to educate the players of these personalities. School students can use these cards as study guides.

Although the present invention has been described with reference to certain embodiments and drawings, it is apparent that modifications and changes may be made therein by those skilled in the art, without departing from the scope of this invention as defined by the appended claims.

What is claimed:

1. A collectible card board game for one or more players comprising (a) a game sheet the surface of which is divided up into a plurality of symmetrically shaped rectangles that are disposed in a horizontal and vertical rows of rectangles, the rows of rectangles are divided up into groups that are color coded and numbered where each group of rectangles either has the same number labeled therein or is consecutively numbered which denotes different categories of collectible figures, the sizes of the groups are from 4–10 depending on the size of the board, and the number of categories are from 2 to 13, (b) a plurality of pocket size game boards where each board that is divided up into from 4–10 rectangularly shaped boxes with each board having the same number in each of the boxes or is consecutively numbered and is the same color but each card in the plurality of game boards is a different color and either has a different number thereon or is numbered consecutively, and (c) a deck of collectible figure cards with each card having thereon a representation of a collectible figure in a particular category of collectibles, each individual card comprises at least 2 leafs with factual information of the collectible figure being on one or more surfaces of the leafs in order to educate a player of vital information concerning the collectible figure and also is color coded and has two stickers that are color coded and has a number thereon corresponding to one of the numbers on the game sheet and game board, each deck of collectible figure cards includes 4 to 10 cards with not more than two cards in the deck having the same color and number thereon.

2. The game of claim 1 wherein the game sheet has spaces for 72 stickers that are divided into 6 groups of twelve members per group.

3. The game of claim 2 wherein the color of the stickers of the 6 groups are blue, purple, green, orange, red, and yellow.

4. The game of claim 3 wherein the deck of cards has six cards therein whereby not more than two cards are in the same category.

5. The game of claim 4 wherein the categories are selected from class of African Americans consisting of Civil Rights Leaders, Scientists, Athletes, Scholars, Writers, Poets, Public Officials, and Entertainers.

6. The game of claim 5 wherein the game cards have two leafs where one of the leafs is a voucher for verification of the stickers.

7. The game of claim 6 wherein a select few of the decks of cards contain a wild card that can be used in place of a single card for completing one category.

* * * * *